US010392709B2

(12) United States Patent
Miyamoto et al.

(10) Patent No.: US 10,392,709 B2
(45) Date of Patent: Aug. 27, 2019

(54) COATED STEEL SHEET, METHOD FOR PRODUCING THE SAME, AND RESIN-COATED STEEL SHEET OBTAINED USING THE SAME

(71) Applicant: JFE STEEL CORPORATION, Chiyoda-ku, Tokyo (JP)

(72) Inventors: Yuka Miyamoto, Kanagawa (JP); Takeshi Suzuki, Chiba (JP); Hiroki Iwasa, Kanagawa (JP); Norihiko Nakamura, Chiba (JP); Masao Inose, Kanagawa (JP); Hisato Noro, Kanagawa (JP); Yoichi Tobiyama, Chiba (JP)

(73) Assignee: JFE Steel Corporation, Tokyo (JP)

( * ) Notice: Subject to any disclaimer, the term of this patent is extended or adjusted under 35 U.S.C. 154(b) by 148 days.

(21) Appl. No.: 15/475,393

(22) Filed: Mar. 31, 2017

(65) Prior Publication Data

US 2017/0204521 A1 Jul. 20, 2017

Related U.S. Application Data

(62) Division of application No. 13/636,858, filed as application No. PCT/JP2011/058154 on Mar. 24, 2011, now abandoned.

(30) Foreign Application Priority Data

Mar. 25, 2010 (JP) ..... 2010-069015
Aug. 19, 2010 (JP) ..... 2010-183825
Sep. 15, 2010 (JP) ..... 2010-206515

(51) Int. Cl.
*C23C 28/02* (2006.01)
*C25D 5/10* (2006.01)
(Continued)

(52) U.S. Cl.
CPC ..... *C23C 28/021* (2013.01); *C21D 8/0221* (2013.01); *C21D 8/0278* (2013.01);
(Continued)

(58) Field of Classification Search
CPC . C23C 18/1653; C23C 28/021; C23C 28/023; C23C 28/028; C23C 28/36;
(Continued)

(56) References Cited

U.S. PATENT DOCUMENTS 6,096,140 A * 8/2000 Susa ..... C23C 22/10 148/253
2009/0032144 A1 2/2009 McMillen et al.
(Continued)

FOREIGN PATENT DOCUMENTS

EP 1486585 A1 12/2004
EP 2006416 A1 12/2008
(Continued)

OTHER PUBLICATIONS

Leisner et al., "Methods for Electrodepositing Composition-Modulated Alloys," Journal of Materials Processing Technology (1996), vol. 56, pp. 39-44. (Year: 1996).*
(Continued)

*Primary Examiner* — Edna Wong
(74) *Attorney, Agent, or Firm* — RatnerPrestia

(57) ABSTRACT

A coated steel sheet includes a corrosion-resistant coating composed of at least one layer selected from the group consisting of a Ni layer, a Sn layer, an Fe—Ni alloy layer, an Fe—Sn alloy layer, and an Fe—Ni—Sn alloy layer disposed on at least one surface of a steel sheet, and an adhesive coating disposed on the corrosion-resistant coating, the adhesive coating containing Zr and further containing at least one metal element selected from the group consisting of Co, Fe, Ni, V, Cu, Mn, and Zn, in total, at a ratio by mass
(Continued)

of 0.01 to 10 with respect to Zr. The coated steel sheet has excellent humid resin adhesion and corrosion resistance, in which streaky surface defects do not occur.

6 Claims, 2 Drawing Sheets

(51) Int. Cl.

| | |
|---|---|
| ***C25D 5/12*** | (2006.01) |
| ***C25D 7/00*** | (2006.01) |
| ***C25D 9/08*** | (2006.01) |
| ***C25D 9/10*** | (2006.01) |
| ***C25D 3/02*** | (2006.01) |
| ***C25D 3/12*** | (2006.01) |
| ***C21D 8/02*** | (2006.01) |
| ***C21D 9/46*** | (2006.01) |
| ***C23C 22/50*** | (2006.01) |
| ***C23G 1/08*** | (2006.01) |
| ***C25D 3/20*** | (2006.01) |
| ***C25D 3/22*** | (2006.01) |
| ***C25D 3/38*** | (2006.01) |
| ***C25D 3/54*** | (2006.01) |
| ***C25D 5/36*** | (2006.01) |
| ***C25F 1/00*** | (2006.01) |
| *C25D 3/30* | (2006.01) |
| *C25D 5/50* | (2006.01) |

(52) U.S. Cl.
CPC ..... *C21D 9/46* (2013.01); *C23C 22/50* (2013.01); *C23G 1/081* (2013.01); *C25D 3/02* (2013.01); *C25D 3/12* (2013.01); *C25D 3/20* (2013.01); *C25D 3/22* (2013.01); *C25D 3/38* (2013.01); *C25D 3/54* (2013.01); *C25D 5/10* (2013.01); *C25D 5/12* (2013.01); *C25D 5/36* (2013.01); *C25D 7/00* (2013.01); *C25D 9/08* (2013.01); *C25D 9/10* (2013.01); *C25F 1/00* (2013.01); *C25D 3/30* (2013.01); *C25D 5/50* (2013.01); *C25D 5/505* (2013.01); *Y10T 428/12569* (2015.01); *Y10T 428/12806* (2015.01)

(58) Field of Classification Search
CPC ..... C23C 28/40; C23C 28/44; C23C 28/02; C25D 5/10; C25D 5/12
USPC ..... 205/184, 170, 176, 181
See application file for complete search history.

(56) References Cited

U.S. PATENT DOCUMENTS

| | | | |
|---|---|---|---|
| 2009/0274926 | A1 | 11/2009 | Okai et al. |
| 2010/0035055 | A1 | 2/2010 | Okai et al. |
| 2010/0270164 | A1 | 10/2010 | Kubota |
| 2013/0266819 | A1 | 10/2013 | Vonk et al. |

FOREIGN PATENT DOCUMENTS

| | | | | |
|---|---|---|---|---|
| EP | 2071055 | A1 * | 6/2009 | ..... C23C 28/00 |
| JP | 2001247977 | A | 9/2001 | |
| JP | 2004307923 | | 11/2004 | |
| JP | 2007284789 | | 11/2007 | |
| JP | 2008088552 | A | 4/2008 | |
| JP | 2008184630 | A | 8/2008 | |
| JP | 2009120919 | | 6/2009 | |
| JP | 2009155665 | A | 7/2009 | |
| JP | 2009280888 | A | 12/2009 | |
| JP | 2009299145 | A | 12/2009 | |
| JP | 2010013728 | A | 1/2010 | |
| JP | 4615807 | B2 * | 1/2011 | ..... C23C 22/40 |
| WO | 0142530 | A1 | 6/2001 | |
| WO | 2007061011 | | 5/2007 | |
| WO | 2009081807 | A1 | 7/2009 | |

OTHER PUBLICATIONS

Chandrasekar et al., "Pulse and Pulse Reverse Plating—Conceptual, Advantages and Applications," Electrochimica Acta (2008), vol. 53, pp. 3313-3322. (Year: 2008).*
European Communication pursuant to Article 94(3) for European Application No. 11759646.0, dated Nov. 24, 2017, 5 pages.
Japanese Office Action for Japanese Application No. 2010-206515, dated Jul. 15, 2014 with Concise Statement of Relevance of Office Action, 4 pages.
Japanese Office Action for Japanese Application No. 2010-206515, dated Jan. 20, 2015 with Concise Statement of Relevance of Office Action, 4 pages.
International Search Report, dated Jun. 14, 2011, Application No. PCT/JP2011/158154—6 Pages.
Supplementary European Search Report, dated Jan. 3, 2014, Application No. EP11759646—6 Pages.

* cited by examiner

COATED STEEL SHEET, METHOD FOR PRODUCING THE SAME, AND RESIN-COATED STEEL SHEET OBTAINED USING THE SAME

CROSS REFERENCE TO RELATED APPLICATIONS

This application is a Divisional Application of U.S. application Ser. No. 13/636,858, filed Jan. 4, 2013, now abandoned, which is a U.S. National Phase application of PCT/JP2011/058154, filed Mar. 24, 2011, and claims priority to Japanese Patent Application Nos. 2010-069015, filed Mar. 25, 2010, 2010-483825, filed Aug. 19, 2010, and 2010-206515, filed Sep. 15, 2010, the disclosures of which are incorporated herein by reference in their entireties for all purposes.

FIELD OF THE INVENTION

The present invention relates to a coated steel sheet which is mainly used for containers, such as cans, after being further coated with a resin in such a manner that the surface of the coated steel sheet is laminated with a resin film or the like or a paint containing a resin is applied onto the surface of the coated steel sheet, and more particularly, relates to a coated steel sheet which has excellent adhesion to a resin coated thereon in a high-temperature, and humid environment (hereinafter, referred to as "humid resin adhesion"), and which exhibits excellent corrosion resistance even if the coated resin peels off. The invention also relates to a method for producing the same, and to a resin-coated steel sheet obtained by further coating the coated steel sheet with a resin.

BACKGROUND OF THE INVENTION

Metal sheets, such as tin-plated steel sheets and electrolytic chromium coated steel sheets referred to as tin-free steel sheets, are used for various metal cans, such as beverage cans, food cans, pail cans, and 18-liter cans. In particular, tin-free steel sheets are produced by subjecting steel sheets to electrolysis in a coating bath containing hexavalent Cr, and have excellent humid resin adhesion to a resin, such as a paint, coated thereon.

In recent years, in response to growing environmental awareness, there has been a worldwide trend toward restricting use of hexavalent Cr, and there has also been a demand for alternative materials to tin-free steel sheets produced using a coating bath of hexavalent Cr.

On the other hand, various metal cans have been conventionally manufactured in such a manner that metal sheets, such as tin-free steel sheets, are painted and then formed into can bodies. In recent years, in order to reduce waste associated with manufacturing operations, a method has come to be frequently used in which a resin-coated metal sheet that is not painted but is coated with a resin, such as a plastic film, and formed into a can body. In the resin-coated metal sheet, the resin needs to strongly adhere to the metal sheet. In particular, resin-coated metal sheets used for beverage cans or food cans are required to have excellent humid resin adhesion such that the resin does not peel off even in a high-temperature and humid environment because the cans may be subjected to a retort process, in some cases, after contents have been packed therein, and are also required to have excellent corrosion resistance such that the cans are prevented from being corroded and pierced by the contents of the cans or the like even when the resin partially peels off owing to being scratched or the like.

Under these requirements, the present inventors have recently proposed, in Patent Literature 1, that it is possible to produce a coated steel sheet having very excellent humid resin adhesion and excellent corrosion resistance, without using Cr, by depositing a corrosion-resistant coating composed of at least one layer selected from the group consisting of a Ni layer, a Sn layer, an Fe—Ni alloy layer, an Fe—Sn alloy layer, and an Fe—Ni—Sn alloy layer on at least one surface of steel sheet, and then depositing an adhesive coating to a resin to be coated thereon by performing cathodic electrolysis in an aqueous solution which includes ions containing Ti and further includes ions containing at least one metal element selected from the group consisting of Co, Fe, Ni, V, Cu, Mn, and Zn.

PATENT LITERATURE

[PTL 1] Japanese Unexamined Patent Application Publication No. 2009-155665

SUMMARY OF THE INVENTION

In the coated steel sheet produced by the method according to Patent Literature 1, streaky surface defects may occur in some cases.

The present invention provides, without using Cr, a coated steel sheet which has excellent humid resin adhesion and corrosion resistance and in which streaky surface defects do not occur, a method for producing the same, and a resin-coated steel sheet obtained using the coated steel sheet.

The present inventors have performed intensive studies and have found that, when an adhesive coating of Patent Literature 1 is deposited, it is effective to perform cathodic electrolysis in an aqueous solution which includes Zr instead of Ti and further includes at least one metal element selected from the group consisting of Co, Fe, Ni, V, Cu, Mn, and Zn.

The present invention has been made based on such a finding. The present invention provides a coated steel sheet characterized by including a corrosion-resistant coating composed of at least one layer selected from the group consisting of a Ni layer, a Sn layer, an Fe—Ni alloy layer, an Fe—Sn alloy layer, and an Fe—Ni—Sn alloy layer disposed on at least one surface of steel sheet, and an adhesive coating disposed on the corrosion-resistant coating, the adhesive coating containing Zr and further containing at least one metal element selected from the group consisting of Co, Fe, Ni, V, Cu, Mn, and Zn, in total, at a ratio by mass of 0.01 to 10 with respect to Zr. In the coated steel sheet of the present invention, preferably, the adhesive coating further contains P derived from a phosphoric acid and/or C derived from a phenolic resin, in total, at a ratio by mass of 0.01 to 10 with respect to Zr. Furthermore, preferably, the Zr coating weight of the adhesive coating is 3 to 200 mg/m$^2$ per one surface.

A coated steel sheet of the present invention can be produced by depositing a corrosion-resistant coating composed of at least one layer selected from the group consisting of a Ni layer, a Sn layer, an Fe—Ni alloy layer, an Fe—Sn alloy layer, and an Fe—Ni—Sn alloy layer on at least one surface of a steel sheet, and depositing an adhesive coating by performing cathodic electrolysis with an electric charge density of 1 to 20 C/dm$^2$ in an aqueous solution which includes Zr in an amount of 0.008 to 0.07 mol/l (l: liter) and further includes at least one metal element selected from the group consisting of Co, Fe, Ni, V, Cu, Mn, and Zn, in total, at a molar ratio of 0.01 to 10 with respect to Zr.

Furthermore, a coated steel sheet of the present invention can be produced by depositing a corrosion-resistant coating composed of at least one layer selected from the group consisting of a Ni layer, a Sn layer, an Fe—Ni alloy layer, an Fe—Sn alloy layer, and an Fe—Ni—Sn alloy layer on at least one surface of a steel sheet, and then depositing an adhesive coating by performing cathodic electrolysis in an aqueous solution which includes Zr in an amount of 0.008 to 0.07 mol/l and further includes at least one metal element selected from the group consisting of Co, Fe, Ni, V, Cu, Mn, and Zn, in total, at a molar ratio of 0.01 to 10 with respect to Zr, under the electrolysis conditions, using an electric current having a current density that changes with a cycle of 0.01 to 0.4 seconds between the current density at which Zr is deposited and the current density at which Zr is not deposited, and having a period of 0.005 to 0.2 seconds per cycle during which Zr is not deposited, in which the number of cycles is 10 or more and the total electric charge density at the current density at which Zr is deposited is 3 to 20 $C/dm^2$. In this case, the upper limit of the current density at which Zr is not deposited is a value that depends on the composition and pH of the aqueous solution used in the cathodic electrolysis. In this production method, it may be possible to use an electric current having a current density that changes in a binary manner between the current density at which Zr is deposited and the current density at which Zr is not deposited. In this case, preferably, the current density at which Zr is not deposited is set at 0 $A/dm^2$.

In any of the production methods described above, preferably, the aqueous solution used in the cathodic electrolysis further includes a phosphoric acid and/or a phenolic resin, in total, at a molar ratio of 0.01 to 10 with respect to Zr.

The present invention also provides a resin-coated steel sheet in which the coated steel sheet of the present invention described above is coated with a resin.

According to the present invention, it has become possible to produce, without using Cr, a coated steel sheet which has excellent humid resin adhesion and corrosion resistance and in which streaky surface defects do not occur. The coated steel sheet of the present invention can be used without any problem as an alternative material to replace conventional tin-free steel sheets and can be used, without being coated with a resin, for containers which contain oil, organic solvents, paint, or the like. Furthermore, when the coated steel sheet is coated with a resin to obtain a resin-coated steel sheet and the resin-coated steel sheet is formed into cans or can lids, and even when the cans or can lids are exposed to a retort atmosphere, the resin does not peel off. In addition, at resin peel-off portions, such as scratches, the amount of dissolving out of Fe of a base steel sheet is markedly small, and very good corrosion resistance is exhibited.

DETAILED DESCRIPTION OF EMBODIMENTS OF THE INVENTION

1) Coated Steel Sheet

Figure 1:
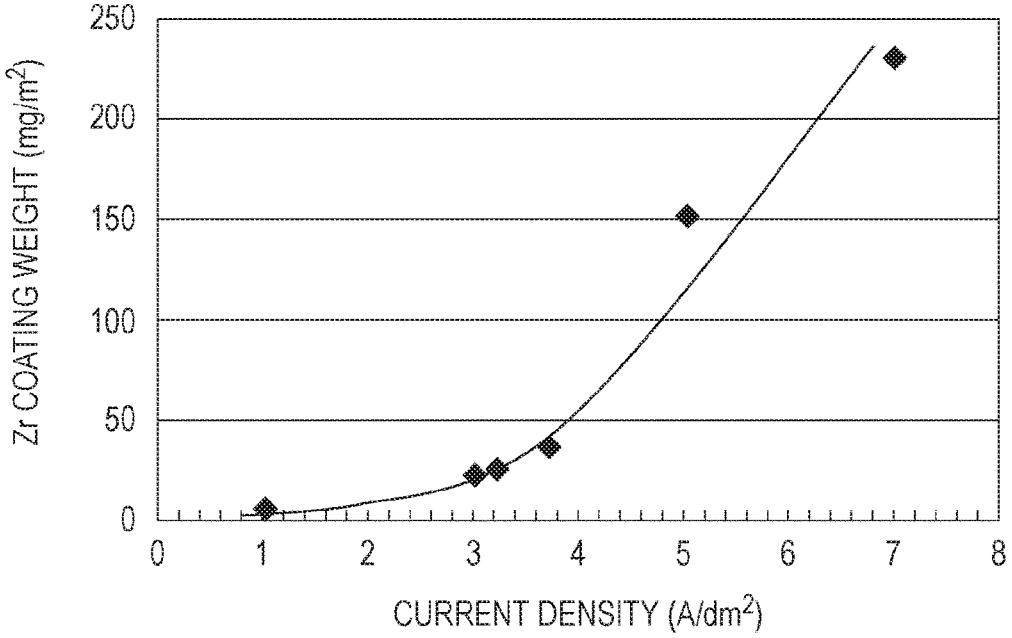
FIG. 1 is a graph showing the relationship between the Zr coating weight and the current density in an aqueous solution, with pH4, containing 12.5 g/l of potassium hexafluorozirconate and 5 g/l of cobalt sulfate heptahydrate.

In a coated steel sheet of an embodiment of the present invention, a corrosion-resistant coating composed of at least one layer selected from the group consisting of a Ni layer, a Sn layer, an Fe—Ni alloy layer, an Fe—Sn alloy layer, and an Fe—Ni—Sn alloy layer is disposed on at least one surface of steel sheet, and an adhesive coating containing Zr and further containing at least one metal element selected from the group consisting of Co, Fe, Ni, V, Cu, Mn, and Zn is disposed thereon.

As a base steel sheet, a low-carbon cold-rolled steel sheet commonly used for cans can be used.

1.1) Corrosion-Resistant Coating

The corrosion-resistant coating disposed on the surface of the base steel sheet needs to be a coating composed of a single layer selected from a Ni layer, a Sn layer, an Fe—Ni alloy layer, an Fe—Sn alloy layer, and an Fe—Ni—Sn alloy layer or a multi-layer including some of these layers so that it strongly bonds to the base steel sheet in order to impart excellent corrosion resistance to the steel sheet even when, after the coated steel sheet is coated with a resin, the resin partially peels off owing to being scratched or the like. In the case of a Ni layer, the Ni coating weight is preferably set at 200 $mg/m^2$ or more per one surface of steel sheet. In the case of an Fe—Ni alloy layer, the Ni coating weight is preferably set at 60 $mg/m^2$ or more per one surface of the steel sheet. In the case of a Sn layer or an Fe—Sn alloy layer, the Sn coating weight is preferably set at 100 $mg/m^2$ or more per one surface of the steel sheet. In the case of an Fe—Ni—Sn alloy layer, preferably, the Ni coating weight is set at 50 $mg/m^2$ or more and the Sn coating weight is set at 100 $mg/m^2$ or more per one surface of the steel sheet. The coating weights of Ni and Sn can be determined by surface analysis using fluorescence X-rays.

Such a corrosion-resistant coating can be disposed by a known method appropriate to the metal element to be contained.

1.2) Adhesive Coating

By disposing, on the corrosion-resistant coating, an adhesive coating containing Zr and further containing at least one metal element selected from the group consisting of Co, Fe, Ni, V, Cu, Mn, and Zn, in total, at a ratio by mass of 0.01 to 10, more preferably 0.01 to 2, with respect to Zr, excellent humid resin adhesion can be obtained, and prevention of occurrence of streaky surface defects is ensured. Although the reason for this is not clear at present, it is believed that by incorporating these metal elements into the coating containing Zr, a dense coating having uniformly distributed surface irregularities is formed.

Preferably, the adhesive coating further contains P derived from a phosphoric acid and/or C derived from a phenolic resin, in total, at a ratio by mass of 0.01 to 10 with respect to Zr. The reason for this is that by incorporating P derived from a phosphoric acid and/or C derived from a phenolic resin into the adhesive coating, coatability of the adhesive coating is further improved and corrosion resistance is improved. Although the reason for improvement in coatability is not clear at present, it is believed that hydroxyl groups present in the adhesive coating, hydroxyl groups of the phenolic resin or hydroxyl groups of the phosphoric acid, and hydroxyl groups present on the surface of the corrosion-resistant coating are crosslinked by dehydration condensation, resulting in covalent bonds between the corrosion-resistant coating and the adhesive coating through oxygen atoms.

In the adhesive coating, the Zr coating weight is preferably 3 to 200 mg/m$^2$ per one surface of the steel sheet. The reason for this is that at a Zr coating weight of 3 to 200 mg/m$^2$, effects of improving humid resin adhesion and preventing occurrence of streaky surface defects can be sufficiently obtained, and at a Zr coating weight exceeding 200 mg/m$^2$, the effects are saturated, resulting in an increase in cost. The Zr coating weight is more preferably 20 to 100 mg/m$^2$.

In the adhesive coating, the total coating weight of at least one metal element selected from the group consisting of Co, Fe, Ni, V, Cu, Mn, and Zn is preferably 10 to 200 mg/m$^2$ per one surface of the steel sheet. When the total coating weight of these metal elements is 10 mg/m$^2$ or more and 200 mg/m$^2$ or less, it is possible to form a coating having excellent humid resin adhesion and having no streaky surface defects.

Preferably, the adhesive coating further includes O. The reason for this is that by incorporating O, the coating becomes mainly composed of oxides of Zr, thus being more effective in improving humid resin adhesion and preventing occurrence of streaky surface defects.

Note that the coating weight of Zr and the coating weights of Co, Fe, Ni, V, Cu, Mn, Zn, and P in the adhesive coating can be determined by surface analysis using fluorescence X-rays. The C content in the adhesive coating can be obtained by subtracting the C content in the steel sheet as a background from the total C content measured by gas chromatography. Although the O content is not particularly specified, the presence of O can be confirmed by surface analysis using XPS (X-ray photoelectron spectrometer).

The adhesive coating can be disposed by performing cathodic electrolysis with an electric charge density of 1 to 20 C/dm$^2$ in an aqueous solution which includes Zr in an amount of 0.008 to 0.07 mol/l, preferably 0.02 to 0.05 mol/l, and further includes at least one metal element selected from the group consisting of Co, Fe, Ni, V, Cu, Mn, and Zn, in total, at a molar ratio of 0.01 to 10, preferably 0.01 to 2.5, more preferably 0.01 to 2, with respect to Zr. When the Zr amount is less than 0.008 mol/l, it is not possible to disposing a coating having excellent humid resin adhesion and having no streaky surface defects. On the other hand, when the Zr amount exceeds 0.07 mol/l, it becomes difficult for Zr to be present in a stable state in the aqueous solution, and Zr oxides are formed. When the total amount, in terms of molar ratio, of at least one metal element selected from the group consisting of Co, Fe, Ni, V, Cu, Mn, and Zn is less than 0.01, it is difficult to dispose a coating having excellent humid resin adhesion and having no streaky surface defects. On the other hand, when the total amount exceeds 10, the effects are saturated, resulting in an increase in cost.

As an aqueous solution containing Zr, an aqueous solution containing fluorozirconate ions or an aqueous solution containing fluorozirconate ions and a fluoride salts is preferable. As a compound that produces fluorozirconate ions, hexafluorozirconic acid, ammonium hexafluorozirconate, potassium hexafluorozirconate, or the like can be used. As a fluoride salt, sodium fluoride, potassium fluoride, silver fluoride, tin fluoride, or the like can be used. In particular, an aqueous solution containing potassium hexafluorozirconate or an aqueous solution containing potassium hexafluorozirconate and sodium fluoride can dispose a homogeneous coating efficiently, which is preferable.

Furthermore, as a compound that produces Co, Fe, Ni, V, Cu, Mn, and Zn, cobalt sulfate, cobalt chloride, iron sulfate, iron chloride, nickel sulfate, copper sulfate, vanadium oxide sulfate, zinc sulfate, manganese sulfate, and the like can be used. In this case, these metal elements are added such that the total amount, in terms of molar ratio with respect to Zr, is 0.01 to 10, preferably 0.01 to 2.5, and more preferably 0.01 to 2.

The cathodic electrolysis may be performed with a current density of 5 to 20 A/dm$^2$ and at an electrolysis time of 1 to 5 sec. Preferably, the electric charge density is set at 3 to 15 C/dm$^2$.

Furthermore, when the cathodic electrolysis is performed, using an electric current having a current density that cyclically changes between the current density at which Zr is deposited and the current density at which Zr is not deposited so that the coating is grown intermittently, it is possible to obtain excellent humid resin adhesion compared with the case where electrolysis is performed continuously at a constant current. For that purpose, it is necessary to secure a certain Zr coating weight. In order to secure the Zr coating weight necessary for achieving productivity (line speed) on a commercial basis, it is preferable to perform cathodic electrolysis under the electrolysis conditions, using an electric current having a current density that changes with a cycle of 0.01 to 0.4 seconds between the current density at which Zr is deposited and the current density at which Zr is not deposited, and having a period of 0.005 to 0.2 seconds per cycle during which Zr is not deposited, in which the number of cycles is 10 or more and the total electric charge density at the current density at which Zr is deposited is 3 to 20 C/dm$^2$. It is believed that, by performing electrolysis under such conditions, at the current density at which Zr is not deposited, redissolution of deposited Zr is promoted rather than it being the case that deposition of Zr does not occur, and therefore, a denser coating having more uniformly distributed surface irregularities is formed, and excellent humid resin adhesion can be obtained.

The upper limit of the current density at which Zr is not deposited, i.e., the current density at the boundary between the case where Zr is not deposited and the case where Zr is deposited, depends on the composition and pH of the aqueous solution including Zr and at least one metal element selected from the group consisting of Co, Fe, Ni, V, Cu, Mn, and Zn. For example, FIG. 1 shows the relationship between the Zr coating weight and the current density in an aqueous solution, with pH4, containing 12.5 g/l of potassium hexafluorozirconate and 5 g/l of cobalt sulfate heptahydrate. In this case, it is obvious that deposition of Zr does not occur at 0.8 A/dm$^2$ or less. As described above, since the upper limit of the current density at which Zr is not deposited depends on the composition and pH of the aqueous solution used in the cathodic electrolysis, it is necessary to predetermine the upper limit depending on the aqueous solution to be used.

As the electric current having a current density that changes cyclically between the current density at which Zr is deposited and the current density at which Zr is not deposited, an alternating current that changes cyclically in a manner similar to a sine curve, or a pulsed current that changes in a binary manner between the current density at which Zr is deposited and the current density at which Zr is not deposited can be used. It is also possible to use a current obtained by superposing an alternating current or a pulsed current on a direct current. In the case where a pulsed current that changes in a binary manner between the current density at which Zr is deposited and the current density at which Zr is not deposited is used, more preferably, the current density at which Zr is not deposited is set at 0 A/dm$^2$ because it eliminates the need to predetermine the upper limit of the current density depending on the aqueous solution to be used.

In the present invention, preferably, the cathodic electrolysis is performed in the aqueous solution which further includes a phosphoric acid and/or a phenolic resin, in total, at a molar ratio of 0.01 to 10 with respect to Zr. The reason for this is that, by performing the cathodic electrolysis in the aqueous solution including phosphoric acid and/or phenolic resin, it is possible to dispose an adhesive coating containing P derived from a phosphoric acid and/or C derived from a phenolic resin, resulting in further improvement in coatability of the adhesive coating and improvement in corrosion resistance. In this case, as a compound that produces a phosphoric acid, orthophosphoric acid or a phosphate compound of the metal element added simultaneously may be used, or nickel phosphate, iron phosphate, cobalt phosphate, zirconium phosphate, or the like can be used. As a phenolic resin, a phenolic resin having a weight-average molecular weight of about 3,000 to 20,000 is preferable, and a phenolic resin having a weight-average molecular weight of about 5,000 is more preferable. Furthermore, the phenolic resin may be provided with water solubility by being amino/alcohol denatured.

2) Resin-Coated Steel Sheet (Laminated Steel Sheet)

A resin-coated steel sheet can be obtained by coating the coated steel sheet of the present invention with a resin. As described above, since the coated steel sheet of the present invention has excellent humid resin adhesion, the resin-coated steel sheet has excellent corrosion resistance and formability.

The resin used to coat the coated steel sheet of the present invention is not particularly limited. For example, any of various thermoplastic resins and thermosetting resins may be used. Examples the resin that can be used include olefin resin films, such as polyethylene, polypropylene, ethylene-propylene copolymers, ethylene-vinyl acetate copolymers, ethylene-acrylic ester copolymers, and ionomers; polyester films, such as polybutylene terephthalate; polyamide films, such as nylon 6, nylon 6,6, nylon 11, and nylon 12; and thermoplastic resin films, such as polyvinyl chloride films and polyvinylidene chloride films. These films may be unoriented or biaxially oriented. In the case where an adhesive is used for lamination, a urethane adhesive, epoxy adhesive, acid-modified olefin resin adhesive, copolyamide adhesive, copolyester adhesive, or the like (thickness: 0.1 to 5.0 μm) is preferable. Furthermore, a thermosetting paint may be applied onto the coated steel sheet or the film with a thickness in the range of 0.05 to 2 μm and used as an adhesive.

Furthermore, thermoplastic or thermosetting paints, such as modified epoxy paints (e.g., phenol epoxy and amino-epoxy paints), vinyl chloride-vinyl acetate copolymers, saponified vinyl chloride-vinyl acetate copolymers, vinyl chloride-vinyl acetate-maleic anhydride copolymers, epoxy-modified-, epoxy amino-modified, or epoxy phenol-modified vinyl paints, or modified vinyl paints, acrylic paints, and synthetic rubber paints (e.g., styrene-butadiene copolymers), may be used alone or in combination of two or more.

The thickness of the resin coating layer is preferably in the range of 3 to 50 μm, and more preferably 5 to 40 μm. When the thickness falls below the range described above, corrosion resistance becomes insufficient. When the thickness exceeds the range described above, a problem in terms of formability is likely to occur.

The resin coating layer can be disposed on the coated steel sheet by any method. For example, an extrusion coating method, a cast film heat bonding method, a biaxially oriented film heat bonding method, or the like can be used. In the extrusion coating method, the coated steel sheet may be extrusion-coated with a resin in a molten state, and the resin is heat-bonded to the coated steel sheet. That is, the resin is melted and kneaded in an extruder and then extruded into a thin film from a T-die. The extruded molten resin film, together with the coated steel sheet, is passed between a pair of lamination rolls, and the thin film and the coated steel sheet are integrated under pressure in a cooling environment, followed by quenching. In the case where a multi-layered resin coating layer is disposed by extrusion coating, it may be possible to use a method in which a plurality of extruders for corresponding layers are used, resin flows from the individual extruders are joined together in a multilayer die, and then extrusion coating is performed in the same manner as that for a single-layer resin. Furthermore, it is possible to dispose resin coating layers on both surfaces of the coated steel sheet by passing the coated steel sheet perpendicularly between a pair of lamination rolls, and supplying a molten resin web onto both surfaces.

The resin-coated steel sheet can be used for three-piece cans with side seams and seamless cans (two-piece cans). The resin-coated steel sheet can also be used for lids of stay-on-tab easy open cans and lids of full open easy open cans.

Described above are merely examples of embodiments of the present invention. Various modifications may be made within the scopes of the present invention.

Example 1

Corrosion-resistant coatings are disposed on both surfaces of cold-rolled steel sheet (thickness: 0.2 mm), which is made as cold-rolled low-carbon steel used to produce a tin-free steel sheet (TFS), using coating bath a or b shown in Table 1, by one of the methods A to D described below.

A: A cold-rolled steel sheet is annealed in an atmosphere of 10 vol % $H_2$ 90 vol % $N_2$ at about 700° C., subjected to temper rolling at an elongation percentage of 1.5%, degreased by alkali electrolysis, pickled with sulfuric acid, and then coated with Ni using the coating bath a to thereby dispose corrosion-resistant coatings made of Ni layers.

B: A cold-rolled steel sheet is degreased by alkali electrolysis, coated with Ni using the coating bath a, annealed in an atmosphere of 10 vol % $H_2$ 90 vol % $N_2$ at about 700° C. to perform diffusion coating of Ni, and then subjected to temper rolling at an elongation percentage of 1.5% to thereby dispose corrosion-resistant coatings made of Fe—Ni alloy layers.

C: A cold-rolled steel sheet is degreased by alkali electrolysis, coated with Ni using the coating bath a, annealed in an atmosphere of 10 vol % $H_2$ 90 vol % $N_2$ at about 700° C. to perform diffusion coating of Ni, subjected to temper rolling at an elongation percentage of 1.5%, followed by degreasing and acid pickling, coated with Sn using the coating bath b, and subjected to melting by heating the steel sheet at a temperature equal to or higher than the melting point of Sn. Thereby, a corrosion-resistant coating including an Fe—Ni—Sn alloy layer and a Sn layer thereon is disposed.

D: A cold-rolled steel sheet is degreased by alkali electrolysis, annealed under the same conditions as the conditions A, subjected to temper rolling, coated with Sn using the coating bath b, and subjected to melting by heating the steel sheet at a temperature equal to or higher than the melting point of Sn. Thereby, a corrosion-resistant coating including an Fe—Sn alloy layer and a Sn layer thereon is disposed.

In the methods C and D, Sn coating is partially alloyed by the melting treatment. The net coating weight of remaining Sn which remains without being alloyed is shown in Tables 3 to 5.

Then, by performing cathodic electrolysis under the cathodic electrolysis conditions shown in Tables 2 to 5, followed by drying, adhesive coatings are formed on the corrosion resistant coatings disposed on both surfaces of each of the steel sheets. Thereby, coated steel sheets Nos. 1 to 33 are produced. Note that coated steel sheet Nos. 1, 16, 19, 22, and 29 are comparative examples, in which the adhesive coating does not contain any of Co, Fe, Ni, V, Cu, Mn, and Zn. Nos. 30 and 31 are comparative examples, in which corrosion-resistant coatings are not disposed. Nos. 32 and 33 are comparative examples, in which adhesive coatings containing Ti and further containing V or Mn are disposed on corrosion-resistant coatings.

The Zr coating weight and Ti coating weight in each adhesive coating are determined by X-ray fluorescence analysis in comparison with a calibration sheet in which the content of each metal is determined by chemical analysis in advance. Furthermore, regarding Co, Fe, Ni, V, Cu, Mn, and Zn, the coating weights contained are determined by a method appropriately selected from X-ray fluorescence analysis, the same technique as that used for Zr and Ti, chemical analysis, Auger electron spectroscopy analysis, and secondary ion mass spectrometry, and the mass ratio of Co, Fe, Ni, V, Cu, Mn, and Zn to Zr or Ti is evaluated. Furthermore, the presence of 0 can be confirmed by XPS surface analysis in each of Nos. 1 to 33.

Furthermore, both surfaces of each of the coated steel sheet Nos. 1 to 33 are laminated with isophthalic acid copolymerized polyethylene terephthalate films (draw ratio: 3.1×3.1, thickness: 25 μm, copolymerization ratio: 12 mol %, melting point: 224° C.) under the laminating conditions such that the degree of biaxial orientation (BO value) of the films is 150, i.e., with a steel sheet feed rate of 40 m/min, a nip length of rubber roll of 17 mm, a period of time from pressure bonding to water cooling of 1 second. Thereby, laminated steel sheet Nos. 1 to 33 are produced. The term "nip length" means the length of a contact portion of a rubber roll with each steel sheet in the feed direction. Regarding the resulting laminated steel sheet Nos. 1 to 33, humid resin adhesion, corrosion resistance, and streaky surface defects are evaluated.

Figure 2C:
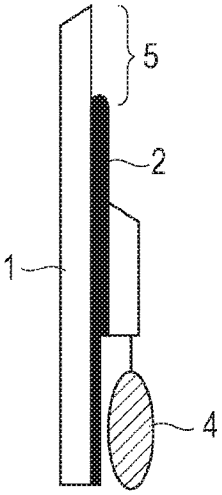
FIG. 2(*a*), FIG. 2(*b*), and FIG. 2(*c*) are views illustrating a 180° peeling test.
Figure 2B:
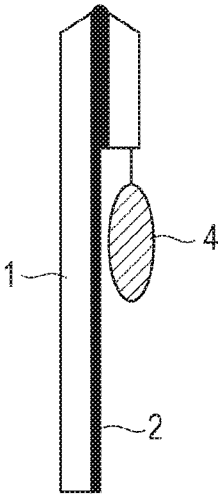
Figure 2A:
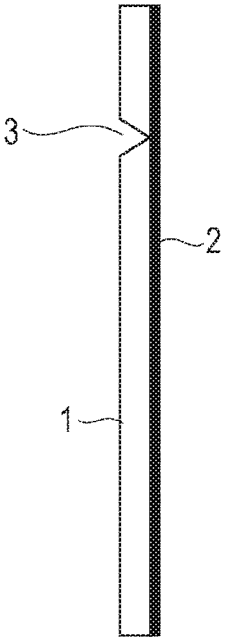

Humid resin adhesion: Humid resin adhesion is evaluated by a 180° peeling test in a retort atmosphere having a temperature of 130° C. and a relative humidity of 100%. The 180° peeling test is a film peel test in which a test piece (size: 30 mm×100 mm, the front and rear surfaces being each n=1, each laminated steel sheet being n=2) obtained by cutting a portion 3 of a steel sheet 1 so that a film 2 remains as shown in FIG. 2(*a*) is used, a weight 4 (100 g) is attached to an end of the test piece, the test piece is folded 180° over the film 2 as shown in FIG. 2(*b*), and the test piece is left to stand for 30 minutes. A peel length 5 shown in FIG. 2(*c*) is measured and evaluated. The peel lengths (n=2) of the front and rear surfaces of each laminated steel sheet are averaged. As the peel length 5 decreases, the test piece is considered to have better humid resin adhesion. When the peel length 5 is less than 20 mm, the test piece is evaluated to have excellent humid resin adhesion targeted in the present invention.

Corrosion resistance: A laminate surface of each laminated steel sheet is cut in a crossing manner with a cutter knife such that the cut depth reaches the base steel sheet, the laminated steel sheet is immersed in 80 ml of a test liquid prepared by mixing equivalent amounts of 1.5% by mass NaCl aqueous solution and 1.5% by mass citric acid aqueous solution, and left to stand at 55° C. for 9 days. The corrosion resistance of the cut portions is evaluated under the following criteria (both surfaces of each laminated steel sheet are evaluated, that is, evaluation number n=2), symbol ○ indicating good corrosion resistance:

○: No corrosion in both n=2.

x: Corrosion in one or more of n=2.

Streaky surface defects: Degree of occurrence of streaky patterns is visually observed and evaluated as follows:

○: No streaky patterns are observed.

x: Streaky patterns are observed.

The results are shown in Table 6. In all of laminated steel sheet Nos. 2 to 15, 17, 18, 20, 21, and 23 to 28, which are examples of the present invention, good humid resin adhesion and corrosion resistance are exhibited, and no streaky surface defects are observed. In contrast, in laminated steel sheet Nos. 1, 16, 19, 22, and 29, which are comparative examples, although there is no problem in corrosion resistance, humid resin adhesion is poor. In laminated steel sheet Nos. 30 and 31, although there is no problem in humid resin adhesion, corrosion resistance is poor. In laminated steel sheet Nos. 32 and 33, although there is no problem in humid resin adhesion or corrosion resistance, streaky patterns are observed on the surface.

TABLE 1

| Coating bath | Bath composition |
|---|---|
| a (Ni coating bath) | Nickel sulfate: 250 g/l, nickel chloride: 45 g/l, boric acid: 30 g/l |
| b (Sn coating bath) | Stunnous sulfate: 55 g/l, phenolsulfonic acid(65% by mass): 35 g/l, brightener: appropriate amount |

TABLE 2

| | | Cathodic electrolysis | | | | | | Corrosion-resistant coating | | | | | |
|---|---|---|---|---|---|---|---|---|---|---|---|---|---|
| | | | | | | | | Coating | | Adhesive coating | | | |
| Coated steel sheet | Coating treatment Coating | Treatment bath | Zr amount in bath | Molar ratio of metal M to Zr in | Current density | Electrolysis time | Electric charge density | weight of Ni and Sn (mg/m²) | | Coating weight of Zr | Additive element | Mass ratio | |
| No. | method | composition | (mol/l) | bath | (A/dm²) | (sec) | (C/dm²) | Ni | Sn | (mg/m²) | M | M/Zr | Remarks |
| 1 | A | Potassium hexafluorozirconate | 0.044 | 0 | 3 | 2.0 | 6.0 | 290 | 0 | 60 | — | 0 | Comparative example |

TABLE 2-continued

| Coated steel sheet No. | Coating treatment Coating method | Cathodic electrolysis: Treatment bath composition | Zr amount in bath (mol/l) | Molar ratio of metal M to Zr in bath | Current density ($A/dm^2$) | Electrolysis time (sec) | Electric charge density ($C/dm^2$) | Corrosion-resistant coating: Coating weight of Ni and Sn ($mg/m^2$) Ni | Sn | Adhesive coating: Coating weight of Zr ($mg/m^2$) | Additive element M | Mass ratio M/Zr | Remarks |
|---|---|---|---|---|---|---|---|---|---|---|---|---|---|
| 2 | A | 12.5 g/l Potassium hexafluorozirconate 12.5 g/l + cobalt chloride hexahydrate 5 g/l | 0.044 | 0.476 | 4 | 1.2 | 4.8 | 295 | 0 | 20 | Co | 0.10 | Example |
| 3 | A | Potassium hexafluorozirconate 12.5 g/l + cobalt chloride hexahydrate 15 g/l | 0.044 | 1.428 | 5 | 1.2 | 6.0 | 295 | 0 | 60 | Co | 1.20 | Example |
| 4 | A | Potassium hexafluorozirconate 6.5 g/l + cobalt chloride hexahydrate 15 g/l | 0.023 | 2.746 | 6 | 1.2 | 7.2 | 295 | 0 | 100 | Co | 1.30 | Example |
| 5 | A | Potassium hexafluorozirconate 12.5 g/l + cobalt sulfate heptahydrate 5 g/l | 0.044 | 0.403 | 5 | 1.2 | 6.0 | 295 | 0 | 60 | Co | 0.10 | Example |
| 6 | A | Potassium hexafluorozirconate 12.5 g/l + cobalt sulfate heptahydrate 5 g/l | 0.044 | 0.403 | 6 | 1.2 | 7.2 | 295 | 0 | 100 | Co | 0.10 | Example |
| 7 | A | Potassium hexafluorozirconate 12.5 g/l + iron sulfate heptahydrate 5 g/l + cobalt chloride hexahydrate 10 g/l | 0.044 | 1.355 | 4 | 1.2 | 4.8 | 295 | 0 | 20 | Fe, Co | 1.20 | Example |
| 8 | A | Potassium hexafluorozirconate 6.3 g/l + iron sulfate heptahydrate 5 g/l | 0.022 | 0.808 | 4 | 1.6 | 6.4 | 295 | 0 | 60 | Fe | 0.11 | Example |
| 9 | A | Potassium hexafluorozirconate 12.5 g/l + iron sulfate heptahydrate 5 g/l | 0.044 | 0.407 | 4 | 1.2 | 4.8 | 295 | 0 | 20 | Fe | 0.10 | Example |
| 10 | A | Potassium hexafluorozirconate 12.5 g/l + copper sulfate pentahydrate 5 g/l | 0.044 | 0.396 | 6 | 1.6 | 9.6 | 300 | 0 | 20 | Cu | 0.10 | Example |
| 11 | A | Potassium hexafluorozirconate 6.5 g/l + vanadium chloride 5 g/l | 0.023 | 1.383 | 6 | 1.6 | 9.6 | 295 | 0 | 20 | V | 0.15 | Example |
| 12 | A | Potassium hexafluorozirconate 12.5 g/l + zinc sulfate heptahydrate 5 g/l | 0.044 | 0.397 | 5 | 1.6 | 8.0 | 295 | 0 | 60 | Zn | 0.12 | Example |
| 13 | A | Potassium hexafluorozirconate 12.5 g/l + manganese sulfate pentahydrate 5 g/l | 0.044 | 0.470 | 6 | 1.6 | 9.6 | 300 | 0 | 20 | Mn | 0.10 | Example |

TABLE 3

| Coated steel sheet No. | Coating treatment Coating method | Cathodic electrolysis: Treatment bath composition | Zr amount in bath (mol/l) | Molar ratio of metal M to Zr in bath | Current density (A/dm$^2$) | Electrolysis time (sec) | Electric charge density (C/dm$^2$) |
|---|---|---|---|---|---|---|---|
| 14 | B | Potassium hexafluorozirconate 12.5 g/l + cobalt sulfate heptahydrate 5 g/l | 0.044 | 0.403 | 5 | 1.2 | 6.0 |
| 15 | B | Potassium hexafluorozirconate 12.5 g/l + iron sulfate heptahydrate 15 g/l | 0.044 | 1.222 | 3 | 1.6 | 4.8 |
| 16 | B | Potassium hexafluorozirconate 12.5 g/l | 0.044 | 0 | 3 | 2.0 | 6.0 |
| 17 | C | Potassium hexafluorozirconate 12.5 g/l + cobalt sulfate heptahydrate 30 g/l | 0.044 | 2.419 | 5 | 1.2 | 6.0 |
| 18 | C | Potassium hexafluorozirconate 12.5 g/l + iron sulfate heptahydrate 15 g/l | 0.044 | 1.222 | 3 | 1.6 | 4.8 |
| 19 | C | Potassium hexafluorozirconate 12.5 g/l | 0.044 | 0 | 3 | 2.0 | 6.0 |
| 20 | C | Potassium hexafluorozirconate 12.5 g/l + cobalt sulfate heptahydrate 30 g/l | 0.044 | 2.419 | 9 | 1.2 | 10.8 |
| 21 | C | Potassium hexafluorozirconate 12.5 g/l + iron sulfate heptahydrate 15 g/l | 0.044 | 1.222 | 5 | 1.2 | 6.0 |
| 22 | C | Potassium hexafluorozirconate 12.5 g/l | 0.044 | 0 | 3 | 2.0 | 6.0 |

| Coated steel sheet No. | Corrosion-resistant coating Ni, Sn, net coating weight of remaining Sn (mg/m$^2$): Ni | Sn | Net coating weight of remaining Sn | Adhesive coating: Coating weight of Zr (mg/m$^2$) | Additive element M | Mass ratio M/Zr | Remarks |
|---|---|---|---|---|---|---|---|
| 14 | 80 | 0 | 0 | 60 | Co | 0.10 | Example |
| 15 | 80 | 0 | 0 | 60 | Fe | 1.00 | Example |
| 16 | 80 | 0 | 0 | 60 | — | 0 | Comparative example |
| 17 | 80 | 150 | 25 | 60 | Co | 3.00 | Example |
| 18 | 80 | 300 | 50 | 60 | Fe | 1.00 | Example |
| 19 | 80 | 300 | 50 | 60 | — | 0 | Comparative example |
| 20 | 80 | 500 | 70 | 60 | Co | 3.00 | Example |
| 21 | 80 | 500 | 70 | 60 | Fe | 1.00 | Example |
| 22 | 80 | 500 | 70 | 60 | — | 0 | Comparative example |

TABLE 4

| Coated steel sheet No. | Coating treatment Coating method | Cathodic electrolysis: Treatment bath composition | Zr amount in bath (mol/l) | Molar ratio of metal M to Zr in bath | Current density (A/dm$^2$) | Electrolysis time (sec) | Electric charge density (C/dm$^2$) |
|---|---|---|---|---|---|---|---|
| 23 | D | Potassium hexafluorozirconate | 0.044 | 1.209 | 8 | 1.2 | 9.6 |

TABLE 4-continued

| | | | | | | | |
|---|---|---|---|---|---|---|---|
| | | 12.5 g/l + cobalt sulfate heptahydrate 15 g/l | | | | | |
| 24 | D | Potassium hexafluorozirconate 12.5 g/l + cobalt sulfate heptahydrate 15 g/l | 0.044 | 1.209 | 6 | 2.0 | 12.0 |
| 25 | D | Potassium hexafluorozirconate 12.5 g/l + cobalt sulfate heptahydrate 15 g/l | 0.044 | 1.209 | 7 | 1.6 | 11.2 |
| 26 | D | Potassium hexafluorozirconate 12.5 g/l + iron sulfate heptahydrate 5 g/l | 0.044 | 0.407 | 5 | 1.2 | 6.0 |
| 27 | D | Potassium hexafluorozirconate 12.5 g/l + nickel sulfate hexahydrate 10 g/l | 0.044 | 0.861 | 6 | 2.0 | 12.0 |
| 28 | D | Potassium hexafluorozirconate 12.5 g/l + iron chloride, anhydrous 5 g/l | 0.044 | 0.892 | 8 | 1.2 | 9.6 |
| 29 | D | Potassium hexafluorozirconate 12.5 g/l | 0.044 | 0 | 4 | 1.2 | 4.8 |
| 30 | None (on steel sheet) | Potassium hexafluorozirconate 12.5 g/l + cobalt sulfate heptahydrate 15 g/l | 0.044 | 1.209 | 5 | 1.2 | 6.0 |
| 31 | None (on steel sheet) | Potassium hexafluorozirconate 12.5 g/l + iron sulfate heptahydrate 5 g/l | 0.044 | 0.407 | 3 | 1.6 | 4.8 |

| | Corrosion-resistant coating Ni, Sn, net coating weight of remaining Sn ($mg/m^2$) | | | Adhesive coating | | | |
|---|---|---|---|---|---|---|---|
| Coated steel sheet No. | Ni | Sn | Net coating weight of remaining Sn | Coating weight of Zr ($mg/m^2$) | Additive element M | Mass ratio M/Zr | Remarks |
| 23 | 0 | 2000 | 1500 | 60 | Co | 1.80 | Example |
| 24 | 0 | 700 | 300 | 100 | Co | 1.80 | Example |
| 25 | 0 | 500 | 70 | 20 | Co | 1.80 | Example |
| 26 | 0 | 500 | 70 | 60 | Fe | 0.80 | Example |
| 27 | 0 | 500 | 70 | 60 | Ni | 0.05 | Example |
| 28 | 0 | 1500 | 900 | 60 | Fe | 0.80 | Example |
| 29 | 0 | 700 | 300 | 60 | — | 0 | Comparative example |
| 30 | — | — | — | 60 | Co | 1.80 | Comparative example |
| 31 | — | — | — | 60 | Fe | 0.80 | Comparative example |

TABLE 5

| Coated steel sheet No. | Coating treatment Coating method | Cathodic electrolysis: Treatment bath composition | Ti amount in bath (mol/l) | Molar ratio of metal M to Ti in bath | Current density (A/dm$^2$) | Elec-trolysis time (sec) | Electric charge density (C/dm$^2$) | Corrosion-resistant coating Ni, Sn, net coating weight of remaining Sn (mg/m$^2$): Ni | Sn | Net coating weight of remaining Sn | Adhesive coating: Coating weight of Ti (mg/m$^2$) | Additive element M | Mass ratio M/Ti | Remarks |
|---|---|---|---|---|---|---|---|---|---|---|---|---|---|---|
| 32 | A | Potassium fluorotitanate 10.6 g/l + vanadium chloride 5 g/l | 0.044 | 0.719 | 6 | 2.0 | 12 | 295 | 0 | 0 | 20 | V | 0.15 | Comparative example |
| 33 | A | Potassium fluorotitanate 10.6 g/l + manganese sulfate pentahydrate 5 g/l | 0.044 | 0.470 | 6 | 2.0 | 12 | 300 | 0 | 0 | 20 | Mn | 0.10 | Comparative example |

TABLE 6

| Laminated steel sheet No. | Humid resin adhesion: peel length (mm) | Corrosion resistance | Streaky surface defects | Remarks |
|---|---|---|---|---|
| 1 | 50 | ○ | ○ | Comparative example |
| 2 | 19 | ○ | ○ | Example |
| 3 | 18 | ○ | ○ | Example |
| 4 | 18 | ○ | ○ | Example |
| 5 | 19 | ○ | ○ | Example |
| 6 | 19 | ○ | ○ | Example |
| 7 | 17 | ○ | ○ | Example |
| 8 | 18 | ○ | ○ | Example |
| 9 | 19 | ○ | ○ | Example |
| 10 | 19 | ○ | ○ | Example |
| 11 | 18 | ○ | ○ | Example |
| 12 | 19 | ○ | ○ | Example |
| 13 | 19 | ○ | ○ | Example |
| 14 | 17 | ○ | ○ | Example |
| 15 | 19 | ○ | ○ | Example |
| 16 | 50 | ○ | ○ | Comparative example |
| 17 | 17 | ○ | ○ | Example |
| 18 | 17 | ○ | ○ | Example |
| 19 | 70 | ○ | ○ | Comparative example |
| 20 | 18 | ○ | ○ | Example |
| 21 | 19 | ○ | ○ | Example |
| 22 | 70 | ○ | ○ | Comparative example |
| 23 | 19 | ○ | ○ | Example |
| 24 | 18 | ○ | ○ | Example |
| 25 | 17 | ○ | ○ | Example |
| 26 | 18 | ○ | ○ | Example |
| 27 | 18 | ○ | ○ | Example |
| 28 | 18 | ○ | ○ | Example |
| 29 | 70 | ○ | ○ | Comparative example |
| 30 | 17 | X | ○ | Comparative example |
| 31 | 17 | X | ○ | Comparative example |
| 32 | 19 | ○ | X | Comparative example |
| 33 | 19 | ○ | X | Comparative example |

Example 2

Corrosion-resistant coatings are formed on both surfaces of each cold-rolled steel sheet (thickness: 0.2 mm), which is made of cold-rolled low-carbon steel used to produce a tin-free steel sheet (TFS), using coating bath a or b shown in Table 1, by one of the methods A to D described above. In the methods C and D, Sn coating is partially alloyed by the melting treatment. The net amount of remaining Sn which remains without being alloyed is shown in Tables 7 to 9.

Then, by performing cathodic electrolysis under the cathodic electrolysis conditions shown in Tables 7 to 9, followed by drying, adhesive coatings are disposed on the corrosion resistant coatings on both surfaces of each of the steel sheets. Thereby, coated steel sheets Nos. 34 to 49 are produced. In this case, the pH of the cathodic electrolysis bath is adjusted by an alkali solution, such as potassium hydroxide, or an acid solution, such as sulfuric acid. Furthermore, in coated steel sheets Nos. 34 to 45, a pulsed current is used, and the current density at which Zr is not deposited is set at 0 A/dm$^2$. On the other hand, in coated steel sheets Nos. 46 and 47, a pulsed current is used, and on the basis of the results shown in FIG. 1, an example in which the current density at which Zr is not deposited is not 0 A/dm$^2$ (No, 46) and an example in which the current density at which Zr is not deposited exceeds the upper limit (No. 47) are taken. Out of these coated steel sheets, in Nos. 38, 45, and 47, the cathodic electrolysis conditions are out of the preferred pulsed current conditions. Nos. 48 and 49 are comparative examples, in which cathodic electrolysis is performed in an aqueous solution containing Ti instead of Zr.

The Ni coating weight and Sn coating weight in each corrosion-resistant coating and the Zr coating weight and Ti coating weight in each adhesive coating are determined by X-ray fluorescence analysis in comparison with a calibration sample in which the content of each metal is determined by chemical analysis in advance. Furthermore, regarding Co, Fe, V, and Mn, the coating weights are determined by a method appropriately selected from X-ray fluorescence analysis, the same technique as that used for Zr and Ti, chemical analysis, Auger electron spectroscopy analysis, and secondary ion mass spectrometry. Furthermore, the presence of 0 can be confirmed by XPS surface analysis in each of Nos. 34 to 49.

Both surfaces of each of the coated steel sheets Nos. 34 to 49 are laminated as in Example 1 to produce laminated steel sheet Nos. 34 to 49. Regarding the resulting laminated steel sheet Nos. 34 to 49, humid resin adhesion, corrosion resistance, and streaky surface defects are evaluated as in Example 1.

The results are shown in Table 10. In all of laminated steel sheet Nos. 34 to 47 using the coated steel sheets which are examples of the present invention, good humid resin adhesion and corrosion resistance are exhibited, and no streaky surface defects are observed. In Nos. 34 to 37, 39 to 44, and 46, in which cathodic electrolysis is performed under the electrolysis conditions, using an electric current having a current density that changes with a cycle of 0.01 to 0.4 seconds and having a period of 0.005 to 0.2 seconds per cycle during which Zr is not deposited, in which the number of cycles is 10 or more and the total electric charge density at the current density at which Zr is deposited is 3 to 20 C/dm$^2$, the peel length of humid resin adhesion is 15 mm or less, and particularly good humid resin adhesion can be obtained. In contrast, in laminated steel sheet Nos. 48 and 49, which are comparative examples, although good humid resin adhesion and corrosion resistance are exhibited, streaky surface defects are observed.

TABLE 7

| | | Cathodic electrolysis | | | | | | | |
|---|---|---|---|---|---|---|---|---|---|
| | | | | | Electrolysis conditions* | | | | |
| | | Treatment bath | | | | | | | |
| Coated steel sheet No. | Coating treatment Method | Composition and pH | Amount of Zr (mol/l) | Molar ratio of metal M to Zr | Current density 2 (A/dm$^2$) | Cycle (sec) | Period per cycle during which current density 2 is maintained (sec) | Number of cycles (No.) | Total electric charge density at current density 1 (C/dm$^2$) |
| 34 | A | Potassium hexafluorozirconate 12.5 g/l + cobalt sulfate heptahydrate 5 g/l pH 4 | 0.044 | 0.403 | 0 | 0.1 | 0.05 | 15 | 3.0 |
| 35 | A | Potassium hexafluorozirconate 12.5 g/l + cobalt sulfate heptahydrate 5 g/l pH 4 | 0.044 | 0.403 | 0 | 0.09 | 0.04 | 15 | 4.0 |
| 36 | A | Potassium hexafluorozirconate 12.5 g/l + iron sulfate heptahydrate 15 g/l pH 4.2 | 0.044 | 1.222 | 0 | 0.1 | 0.05 | 15 | 3.0 |
| 37 | A | Potassium hexafluorozirconate 12.5 g/l + iron sulfate heptahydrate 5 g/l + cobalt sulfate heptahydrate 4 g/l pH 4.1 | 0.044 | 0.407 | 0 | 0.05 | 0.03 | 20 | 5.0 |
| 38 | A | Potassium hexafluorozirconate 12.5 g/l + cobalt sulfate heptahydrate 5 g/l pH 4 | 0.044 | 0.403 | 0 | 0.7 | 0.40 | 4 | 6.0 |
| 39 | B | Potassium hexafluorozirconate 12.5 g/l + cobalt sulfate heptahydrate 5 g/l pH 4 | 0.044 | 0.403 | 0 | 0.1 | 0.05 | 15 | 3.0 |
| 40 | C | Potassium hexafluorozirconate 12.5 g/l + cobalt sulfate heptahydrate 5 g/l pH 4 | 0.044 | 0.403 | 0 | 0.1 | 0.05 | 15 | 3.0 |

TABLE 7-continued

| Coated steel sheet No. | Corrosion-resistant coating Ni, Sn, net coating weight of remaining Sn (mg/m²) Ni | Sn | Net coating weight of remaining Sn | Adhesive coating Coating weight of Zr (mg/m²) | Additive element M | Mass ratio M/Zr | Remarks |
|---|---|---|---|---|---|---|---|
| 34 | 295 | 0 | 0 | 40 | Co | 1.22 | Example |
| 35 | 295 | 0 | 0 | 60 | Co | 1.46 | Example |
| 36 | 295 | 0 | 0 | 50 | Fe | 0.86 | Example |
| 37 | 295 | 0 | 0 | 30 | Fe, Co | 1.67 | Example |
| 38 | 295 | 0 | 0 | 60 | Co | 0.10 | Example |
| 39 | 70 | 0 | 0 | 40 | Co | 1.22 | Example |
| 40 | 70 | 100 | 0 | 40 | Co | 1.22 | Example |

*Current density 1: current density at which Zr is deposited, Current density 2: current density at which Zr is not deposited

TABLE 8

| Coated steel sheet No. | Coating treatment Method | Cathodic electrolysis: Treatment bath Composition and pH | Amount of Zr (mol/l) | Molar ratio of metal M to Zr | Electrolysis conditions*: Current density 2 (A/dm²) | Cycle (sec) | Period per cycle during which current density 2 is maintained (sec) | Number of cycles (No.) | Total electric charge density at current density 1 (C/dm²) |
|---|---|---|---|---|---|---|---|---|---|
| 41 | D | Potassium hexafluorozirconate 12.5 g/l + cobalt sulfate heptahydrate 5 g/l pH 4 | 0.044 | 0.403 | 0 | 0.1 | 0.05 | 15 | 3.0 |
| 42 | D | Potassium hexafluorozirconate 12.5 g/l + cobalt sulfate heptahydrate 5 g/l pH 4 | 0.044 | 0.403 | 0 | 0.09 | 0.04 | 15 | 4.0 |
| 43 | D | Potassium hexafluorozirconate 12.5 g/l + iron sulfate heptahydrate 15 g/l pH 4.2 | 0.044 | 1.222 | 0 | 0.1 | 0.05 | 15 | 3.0 |
| 44 | D | Potassium hexafluorozirconate 12.5 g/l + iron sulfate heptahydrate 5 g/l + cobalt sulfate heptahydrate 4 g/l pH 4.1 | 0.044 | 0.729 | 0 | 0.05 | 0.03 | 20 | 5.0 |
| 45 | D | Potassium hexafluorozirconate 12.5 g/l + iron sulfate heptahydrate 5 g/l pH 4.2 | 0.044 | 0.407 | 0 | 0.70 | 0.40 | 4 | 6.0 |

| Coated steel sheet No. | Corrosion-resistant coating Ni, Sn, net coating weight of remaining Sn (mg/m²) Ni | Sn | Net coating weight of remaining Sn | Adhesive coating Coating weight of Zr (mg/m²) | Additive element M | Mass ratio M/Zr | Remarks |
|---|---|---|---|---|---|---|---|

TABLE 8-continued

| | | | | | | | |
|---|---|---|---|---|---|---|---|
| 41 | 0 | 500 | 70 | 40 | Co | 1.22 | Example |
| 42 | 0 | 700 | 300 | 60 | Co | 1.46 | Example |
| 43 | 0 | 500 | 0 | 50 | Fe | 0.86 | Example |
| 44 | 0 | 500 | 30 | 30 | Fe, Co | 1.67 | Example |
| 45 | 0 | 500 | 70 | 60 | Fe | 0.80 | Example |

*Current density 1: current density at which Zr is deposited, Current density 2: current density at which Zr is not deposited

TABLE 9

| | | Cathodic electrolysis | | | | | | | |
|---|---|---|---|---|---|---|---|---|---|
| | | | | | Electrolysis conditions* | | | | |
| | | Treatment bath | | | | | | | |
| Coated steel sheet No. | Coating treatment Method | Composition and pH | Amount of Zr(Ti) (mol/l) | Molar ratio of metal M to Zr (Ti) | Current density 2 (A/dm$^2$) | Cycle (sec) | Period per cycle during which current density 2 is maintained (sec) | Number of cycles (No.) | Total electric charge density at current density 1 (C/dm$^2$) |
| 46 | A | Potassium hexafluorozirconate 12.5 g/l + cobalt sulfate heptahydrate 5 g/l pH 4 | 0.044 | 0.403 | 0.5 | 0.1 | 0.05 | 15 | 3.0 |
| 47 | A | Potassium hexafluorozirconate 12.5 g/l + cobalt sulfate heptahydrate 5 g/l pH 4 | 0.044 | 0.403 | 3.5 | 0.1 | 0.05 | 15 | 3.0 |
| 48 | A | Potassium fluorotitanate 10.6 g/l + vanadium chloride 5 g/l pH 3.5 | (0.044) | (0.931) | 0 | 0.9 | 0.40 | 4 | 12.0 |
| 49 | A | Potassium fluorotitanate 10.6 g/l + manganese sulfate pentahydrate 5 g/l pH 3.5 | (0.044) | (0.531) | 0 | 0.9 | 0.40 | 4 | 12.0 |

| | Corrosion-resistant coating Ni, Sn, net coating weight of remaining Sn (mg/m$^2$) | | | Adhesive coating | | | |
|---|---|---|---|---|---|---|---|
| Coated steel sheet No. | Ni | Sn | Net coating weight of remaining Sn | Coating weight of Zr(Ti) (mg/m$^2$) | Additive element M | Mass ratio M/Zr(Ti) | Remarks |
| 46 | 295 | 0 | 0 | 40 | Co | 1.22 | Example |
| 47 | 295 | 0 | 0 | 40 | Co | 1.22 | Example |
| 48 | 295 | 0 | 0 | 20 | V | 0.15 | Comparative example |
| 49 | 300 | 0 | 0 | 20 | Mn | 0.10 | Comparative example |

*Current density 1: current density at which Zr(Ti) is deposited, Current density 2: current density at which Zr(Ti) is not deposited

TABLE 10

| Laminated steel sheet No. | Humid resin adhesion: peel length (mm) | Corrosion resistance | Streaky surface defects | Remarks |
|---|---|---|---|---|
| 34 | 15 | ○ | ○ | Example |
| 35 | 14 | ○ | ○ | Example |

TABLE 10-continued

| Laminated steel sheet No. | Humid resin adhesion: peel length (mm) | Corrosion resistance | Streaky surface defects | Remarks |
|---|---|---|---|---|
| 36 | 14 | ○ | ○ | Example |
| 37 | 15 | ○ | ○ | Example |

TABLE 10-continued

| Laminated steel sheet No. | Humid resin adhesion: peel length (mm) | Corrosion resistance | Streaky surface defects | Remarks |
|---|---|---|---|---|
| 38 | 19 | ○ | ○ | Example |
| 39 | 14 | ○ | ○ | Example |
| 40 | 15 | ○ | ○ | Example |
| 41 | 15 | ○ | ○ | Example |
| 42 | 14 | ○ | ○ | Example |
| 43 | 14 | ○ | ○ | Example |
| 44 | 15 | ○ | ○ | Example |
| 45 | 18 | ○ | ○ | Example |
| 46 | 14 | ○ | ○ | Example |
| 47 | 19 | ○ | ○ | Example |
| 48 | 8 | ○ | X | Comparative example |
| 49 | 9 | ○ | X | Comparative example |

Example 3

Corrosion-resistant coatings are formed on both surfaces of each cold-rolled steel sheet (thickness: 0.2 mm), which is made of cold-rolled low-carbon steel used to produce a tin-free steel sheet (TFS), using coating bath a or b shown in Table 1, by one of the methods A to D described above. In the methods C and D, Sn coating is partially alloyed by the heat melting treatment. The net coating weight of remaining Sn which remains without being alloyed is shown in Tables 11 and 12.

Then, by performing cathodic electrolysis under the cathodic electrolysis conditions shown in Tables 11 and 12, followed by drying, adhesive coatings are formed on the corrosion resistant coatings disposed on both surfaces of each of the steel sheets. Thereby, coated steel sheets Nos. 50 to 60 are produced. In this case, the pH of the coating bath is adjusted by an alkali solution, such as potassium hydroxide, or an acid solution, such as sulfuric acid. Furthermore, in coated steel sheets Nos. 54 to 60, a pulsed current is used, and the current density at which Zr is not deposited is set at 0 A/dm$^2$. Furthermore, as the phenolic resin in the coating bath, a phenolic resin with a weight-average molecular weight of 5,000 is used.

The Ni coating weight and Sn coating weight in each corrosion-resistant coating and the Zr coating weight in each adhesive coating are determined by X-ray fluorescence analysis in comparison with a calibration sample in which the content of each metal is determined by chemical analysis in advance. Furthermore, regarding Co and P, the contents are determined by a method appropriately selected from X-ray fluorescence analysis, the same technique as that used for Zr, chemical analysis, Auger electron spectroscopy analysis, and secondary ion mass spectrometry, and the mass ratio of Co and P to Zr is evaluated. Furthermore, the presence of O can be confirmed by XPS surface analysis in each of Nos. 50 to 60. Furthermore, the C content in the adhesive coating is obtained by subtracting the C content in the steel sheet as a background from the total C content measured by gas chromatography.

Both surfaces of each of the coated steel sheets Nos. 50 to 60 are laminated as in Example 1 to produce laminated steel sheet Nos. 50 to 60. Regarding the resulting laminated steel sheet Nos. 50 to 60, humid resin adhesion, corrosion resistance, and streaky surface defects are evaluated as in Example 1.

The results are shown in Table 13. In all of laminated steel sheet Nos. 50 to 60 which are examples of the present invention, good humid resin adhesion and corrosion resistance are exhibited, and no streaky surface defects are observed. In Nos. 54 to 60, in which cathodic electrolysis is performed using a pulsed current, the peel length of humid resin adhesion is 15 mm or less, and particularly good humid resin adhesion can be obtained. In adhesive coatings containing Zr, point rust may be observed in portions other than the cut portion after the corrosion resistance test in some cases. However, when P derived from a phosphoric acid or C derived from a phenolic resin is incorporated into coatings as in the examples of the present invention, no point rust is observed.

TABLE 11

| | | Cathodic electrolysis | | | | | |
|---|---|---|---|---|---|---|---|
| | | Treatment bath | | | electrolysis conditions | | |
| Coated steel sheet No. | Coating treatment Method | Composition | Amount of Zr (mol/l) | Molar ratio of metal M to Zr | Current density (A/dm$^2$) | Electrolysis time (sec) | Electric charge density (C/dm$^2$) |
| 50 | A | Potassium hexafluorozirconate 12.5 g/l + cobalt sulfate heptahydrate 5 g/l + orthophosphoric acid 1 g/l | 0.044 | 0.403 | 7 | 1.5 | 10.5 |
| 51 | C | Potassium hexafluorozirconate 12.5 g/l + cobalt sulfate heptahydrate 5 g/l + orthophosphoric acid 1 g/l | 0.044 | 0.403 | 7 | 1.5 | 10.5 |
| 52 | B | Potassium hexafluorozirconate 12.5 g/l + cobalt sulfate heptahydrate 5 g/l + orthophosphoric acid 1 g/l + phenolic resin | 0.044 | 0.403 | 7 | 1.5 | 10.5 |

TABLE 11-continued

| | | | | | | | |
|---|---|---|---|---|---|---|---|
| 53 | D | 0.5 g/l Potassium hexafluorozirconate 12.5 g/l + cobalt sulfate heptahydrate 5 g/l + orthophosphoric acid 1 g/l + phenolic resin 0.9 g/l | 0.044 | 0.403 | 6 | 1.5 | 9.0 |

| Coated steel sheet No. | Corrosion-resistant coating Ni, Sn, net coating weight of remaining Sn ($mg/m^2$) Ni | Sn | Net coating weight of remaining Sn | Adhesive coating Coating weight of Zr ($mg/m^2$) | Additive element M | Mass ratio M/Zr | Mass ratio P/Zr | Mass ratio C/Zr | Remarks |
|---|---|---|---|---|---|---|---|---|---|
| 50 | 300 | 0 | 0 | 10 | Co | 2.00 | 0.4 | — | Example |
| 51 | 80 | 150 | 25 | 30 | Co | 2.00 | 0.1 | — | Example |
| 52 | 70 | 0 | 0 | 30 | Co | 2.00 | 0.1 | 0.1 | Example |
| 53 | 0 | 500 | 0 | 5 | Co | 2.00 | 0.7 | 0.8 | Example |

TABLE 12

| | | Cathodic electrolysis | | | | | | | |
|---|---|---|---|---|---|---|---|---|---|
| | | Treatment bath | | | Electrolysis conditions* | | | | |
| Coated steel sheet No. | Coating treatment Method | Composition | Amount of Zr (mol/l) | Molar ratio of metal M to Zr | Current density 2 ($A/dm^2$) | Cycle (sec) | Period per cycle during which current density 2 is maintained (sec) | Number of cycles (No.) | Total electric charge density at current density 1 ($C/dm^2$) |
| 54 | A | Potassium hexafluorozirconate 12.5 g/l + cobalt sulfate heptahydrate 5 g/l + orthophosphoric acid 1 g/l | 0.044 | 0.403 | 0 | 0.1 | 0.05 | 15 | 3.0 |
| 55 | D | Potassium hexafluorozirconate 12.5 g/l + cobalt sulfate heptahydrate 5 g/l + orthophosphoric acid 1 g/l | 0.044 | 0.403 | 0 | 0.1 | 0.05 | 15 | 3.0 |
| 56 | A | Potassium hexafluorozirconate 12.5 g/l + cobalt sulfate heptahydrate 5 g/l + orthophosphoric acid 1 g/l + phenolic resin 0.9 g/l | 0.044 | 0.403 | 0 | 0.1 | 0.05 | 25 | 4.0 |
| 57 | B | Potassium hexafluorozirconate 12.5 g/l + cobalt sulfate heptahydrate 5 g/l + orthophosphoric acid 1 g/l + phenolic resin 0.9 g/l | 0.044 | 0.403 | 0 | 0.1 | 0.05 | 15 | 3.0 |
| 58 | C | Potassium hexafluorozirconate 12.5 g/l + cobalt sulfate heptahydrate 5 g/l + orthophosphoric acid | 0.044 | 0.403 | 0 | 0.1 | 0.05 | 15 | 3.0 |

TABLE 12-continued

| | | | | | | | | | |
|---|---|---|---|---|---|---|---|---|---|
| | | 1 g/l + phenolic resin 0.9 g/l | | | | | | | |
| 59 | D | Potassium hexafluorozirconate 12.5 g/l + cobalt sulfate heptahydrate 5 g/l + orthophosphoric acid 1 g/l + phenolic resin 0.5 g/l | 0.044 | 0.403 | 0 | 0.1 | 0.05 | 25 | 4.0 |
| 60 | D | Potassium hexafluorozirconate 12.5 g/l + cobalt sulfate heptahydrate 5 g/l + orthophosphoric acid 1 g/l + phenolic resin 0.9 g/l | 0.044 | 0.403 | 0 | 0.1 | 0.05 | 15 | 3.0 |

| | Corrosion-resistant coating Ni, Sn, net coating weight of remaining Sn ($mg/m^2$) | | | | Adhesive coating | | | | |
|---|---|---|---|---|---|---|---|---|---|
| Coated steel sheet No. | Ni | Sn | net coating weight of remaining Sn | Coating weight of Zr ($mg/m^2$) | Additive element M | Mass ratio M/Zr | Mass ratio P/Zr | Mass ratio C/Zr | Remarks |
| 54 | 300 | 0 | 0 | 30 | Co | 1.67 | 0.4 | — | Example |
| 55 | 0 | 500 | 0 | 8 | Co | 2.00 | 0.5 | — | Example |
| 56 | 300 | 0 | 0 | 12 | Co | 2.00 | 0.3 | 0.3 | Example |
| 57 | 70 | 0 | 0 | 8 | Co | 2.00 | 0.5 | 0.5 | Example |
| 58 | 70 | 700 | 200 | 8 | Co | 2.00 | 0.5 | 0.5 | Example |
| 59 | 0 | 500 | 0 | 12 | Co | 2.00 | 0.3 | 0.3 | Example |
| 60 | 0 | 800 | 200 | 8 | Co | 2.00 | 0.5 | 0.5 | Example |

*Current density 1: current density at which Zr is deposited, Current density 2: current density at which Zr is not deposited

TABLE 13

| Laminated steel sheet No. | Humid resin adhesion: peel length (mm) | Corrosion resistance | Streaky surface defects | Remarks |
|---|---|---|---|---|
| 50 | 17 | ○ | ○ | Example |
| 51 | 17 | ○ | ○ | Example |
| 52 | 19 | ○ | ○ | Example |
| 53 | 17 | ○ | ○ | Example |
| 54 | 12 | ○ | ○ | Example |
| 55 | 13 | ○ | ○ | Example |
| 56 | 12 | ○ | ○ | Example |
| 57 | 12 | ○ | ○ | Example |
| 58 | 15 | ○ | ○ | Example |
| 59 | 12 | ○ | ○ | Example |
| 60 | 15 | ○ | ○ | Example |

According to the present invention, it is possible to produce, even without using Cr which is strictly environmentally regulated, a coated steel sheet which has excellent humid resin adhesion and corrosion resistance and in which streaky surface defects do not occur. The coated steel sheet of the present invention can be used without any problem as an alternative material to replace conventional tin-free steel sheets and can be used, without being coated with a resin, for containers which contain oil, organic solvents, paint, or the like. Furthermore, when the coated steel sheet is coated with a resin to obtain a resin-coated steel sheet and the resin-coated steel sheet is formed into cans or can lids, and even when the cans or can lids are exposed to a retort atmosphere, the resin does not peel off. Furthermore, at resin peel-off portions, such as scratches, the amount of dissolving out of Fe of a base steel sheet is markedly small, and very good corrosion resistance is exhibited. Therefore, the present invention can greatly contribute to the industry.

REFERENCE SIGNS LIST

1 steel sheet
2 film
3 cut portion of steel sheet
4 weight
5 peel length

What is claimed:

1. A method for producing a coated steel sheet comprising:

depositing a corrosion-resistant coating composed of at least one layer selected from the group consisting of a Ni layer, a Sn layer, an Fe—Ni alloy layer, an Fe—Sn alloy layer, and an Fe—Ni—Sn alloy layer on at least one surface of a steel sheet; and disposing an adhesive coating by performing cathodic electrolysis with an electric charge density of 1 to 20 $C/dm^2$ in an aqueous solution which includes Zr in an amount of 0.008 to 0.07 mol/l and further includes at least one metal element selected from the group consisting of Co, Fe, Ni, Cu, Mn, and Zn, in total, at a molar ratio of 0.01 to 10 with respect to Zr.

2. The method for producing a coated steel sheet according to claim 1, wherein the aqueous solution further includes a phosphoric acid and/or a phenolic resin, in total, at a molar ratio of 0.01 to 10 with respect to Zr.

3. A method for producing a coated steel sheet comprising:

disposing a corrosion-resistant coating composed of at least one layer selected from the group consisting of a Ni layer, a Sn layer, an Fe—Ni alloy layer, an Fe—Sn alloy layer, and an Fe—Ni—Sn alloy layer on at least one surface of a steel sheet; and disposing an adhesive coating by performing cathodic electrolysis in an aqueous solution which includes Zr in an amount of 0.008 to 0.07 mol/l and further includes at least one metal element selected from the group consisting of Co, Fe, Ni, Cu, Mn, and Zn, in total, at a molar ratio of 0.01 to 10 with respect to Zr, under electrolysis conditions including an electric current having a current density that changes with a cycle of 0.01 to 0.4 seconds between the current density at which Zr is deposited and the current density at which Zr is not deposited, and having a period of 0.005 to 0.2 seconds per cycle during which Zr is not deposited, in which the number of cycles is 10 or more and the total electric charge density at the current density at which Zr is deposited is 3 to 20 $C/dm^2$, wherein the upper limit of the current density at which Zr is not deposited is a value that depends on the composition and pH of the aqueous solution used in the cathodic electrolysis.

4. The method for producing a coated steel sheet according to claim 3, further comprising using an electric current having a current density that changes in a binary manner between the current density at which Zr is deposited and the current density at which Zr is not deposited.

5. The method for producing a coated steel sheet according to claim 4, wherein the current density at which Zr is not deposited is set at 0 $A/dm^2$.

6. The method for producing a coated steel sheet according to claim 3, wherein the aqueous solution further includes a phosphoric acid and/or a phenolic resin, in total, at a molar ratio of 0.01 to 10 with respect to Zr.

* * * * *